US005451730A

United States Patent [19]

Phillips, Sr.

[11] Patent Number: 5,451,730

[45] Date of Patent: Sep. 19, 1995

[54] ELECTRICAL SAFETY APPARATUS

[76] Inventor: James M. Phillips, Sr., 102 Western Dr., No. A 12, Kingwood, W. Va. 26537

[21] Appl. No.: 283,502

[22] Filed: Aug. 1, 1994

[51] Int. Cl.[6] ..... H01H 9/28

[52] U.S. Cl. ..... 200/43.11; 200/331; 200/330; 200/43.14; 294/19.1; 70/203

[58] Field of Search ..... 200/43.11, 43.14, 43.15, 200/43.16, 43.19, 43.21, 43.04, 343.07, 329, 330, 331, 332, 337, 338, 320, 321, 322, 339, 48 KB, 48 A, 49; 16/115, 111 R, 112, 114 R; 294/19.1; 70/DIG. 30, 201, 202, 203, 209

[56] References Cited

U.S. PATENT DOCUMENTS 1,463,320 7/1923 Jacobs ..... 200/43.11
1,718,398 6/1929 Zaeske ..... 294/19.1
1,774,540 9/1930 Alsaker et al. ..... 200/43.11
2,759,758 8/1956 Yancey ..... 294/19.1
4,095,061 6/1978 Bridges ..... 200/48 KB

*Primary Examiner*—Henry J. Recla
*Assistant Examiner*—David J. Walczak
*Attorney, Agent, or Firm*—George J. Neilan

[57] ABSTRACT

Safety apparatus for disconnecting overhead electrical switches for maintenance, comprising an insulated rod having an upper disconnect hook to engage a handle of a switch box and move it from an on position to an off position in which power is disconnected, an arm attached to the rod and cooperating with the hook to secure the switch handle in the off position, and a locking device connected to the arm and to the rod to prevent inadvertent movement of the switch handle to the on position.

6 Claims, 2 Drawing Sheets

ELECTRICAL SAFETY APPARATUS

BACKGROUND OF THE INVENTION

The invention relates to an apparatus for disconnecting overhead electrical switches so that maintenance may be performed, and for ensuring that the switch can not be inadvertently returned to the on position.

According to present practice and in keeping with federal laws and occupational safety and health standards; when overhead electrical switches are disengaged for maintenance, an electrician climbs up to the switch and applies a so-called locking-out device to the switch to prevent the switch from being moved to the on position. After maintenance is completed; the electrician again climbs up to the switch to remove the locking-out device and to move the switch to the on position.

SUMMARY OF THE INVENTION

The present invention is a combined so-called hot stick which is used to operate overhead electrical switches to turn the power off for maintenance and a so-called locking out device which is attached to the switch to prevent the switch being moved to the on position while maintenance is being performed.

In accordance with the invention, a single tool may be used to disconnect an overhead electrical switch, lock-out the switch in an off or disconnected position, and later reconnect the switch without the inconvenience of an electrician having to climb up to the switch.

Briefly, the invention includes an electrical safety apparatus to operate an overhead electrical switch such as a buss bar switch, a switch handle movable from an on to a disconnected power or off position, a hot stick apparatus for engaging and moving the handle between the on and off positions and including an insulated rod with a hook at its upper end which engages and moves the handle, a locking ear contiguous to the off position, a locking arm attached to the rod and together with the hook being connected to the locking ear to secure the handle in the off position, and a lock accessible from ground level and connected to the locking arm to prevent inadvertent movement of the switch from the off to the on position.

DETAILED DESCRIPTION OF THE INVENTION

Figure 1:
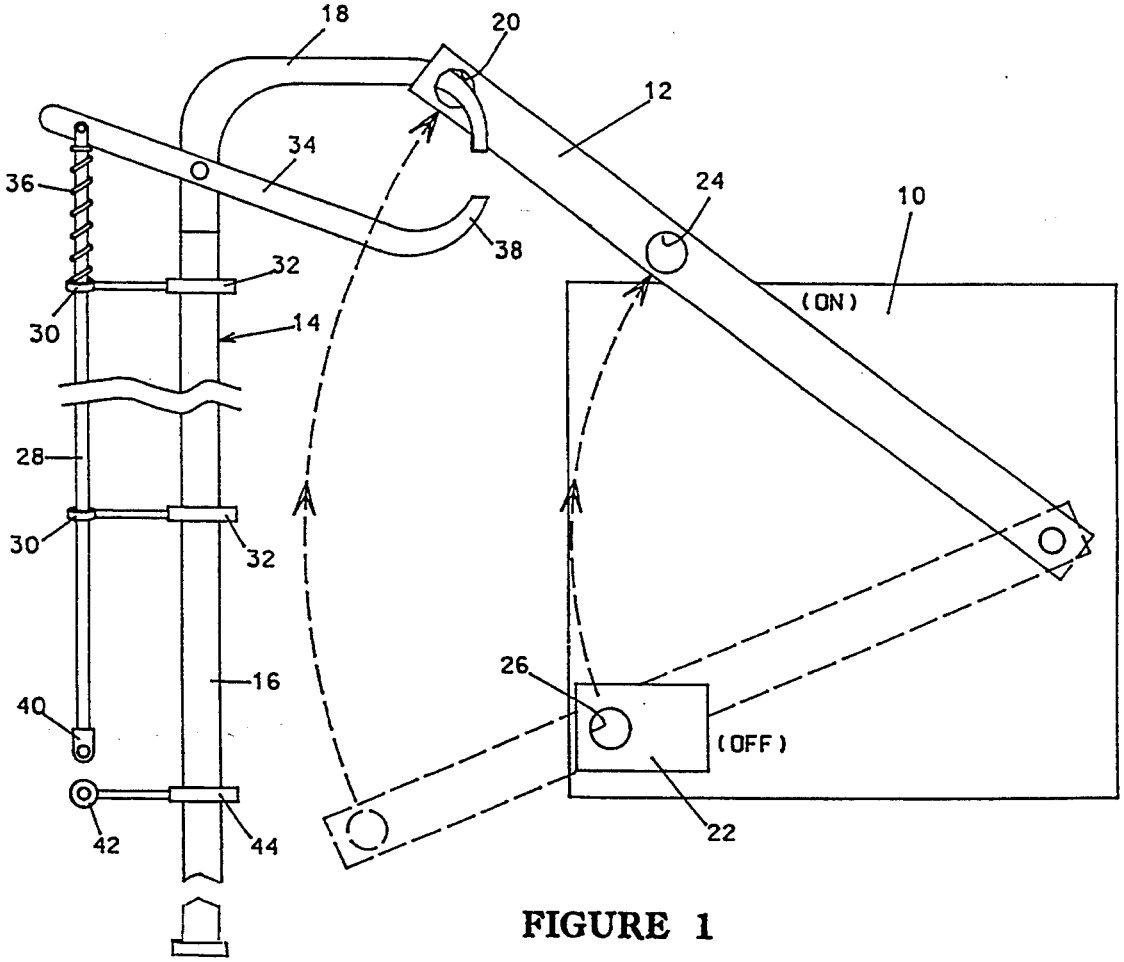
FIG. 1 is an elevational view of a presently preferred embodiment of the invention showing an overhead electrical switch in an on position.

Referring to the drawings, reference numeral 10 diagramatically illustrates an overhead industrial electrical switch, such as a buss bar switch, that has a switch handle 12. The switch handle 12 is movable from an upper on position, shown in FIG. 1 in which the switch is hot, that is has power supplied through it, to a lower off position, shown in FIG. 2.

A hot stick generally indicated by reference numeral 14 engages and moves the switch handle between the on and off positions. Hot stick 14 includes an insulated rod

16 of sufficient length to enable an electrician standing at ground level to reach the switch handle 12, A hook 18 at the upper end of the rod 16 may be inserted into an aperture 20 in the free end of switch handle 12. If it is necessary to disconnect power from switch 10 for maintenance or the like; by pulling downwardly on rod 16, handle 12 is rotated from the on position to the lower off position in which the handle 12 abuts against an L shaped locking ear 22 or similar locking device.

Figures 2, 3:
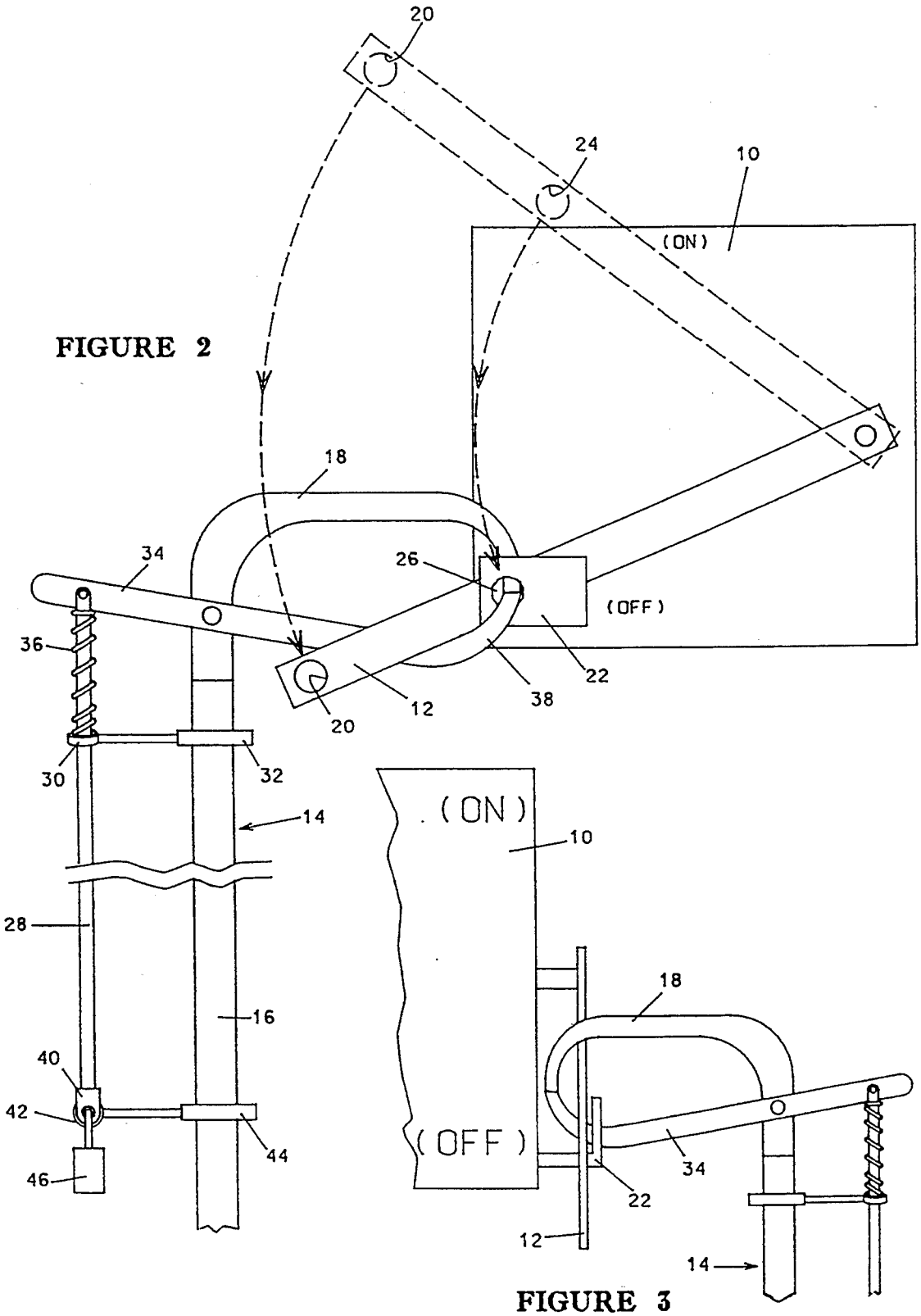
FIG. 2 is a view similar to FIG. 1, but showing the switch having been moved to the off position.
FIG. 3 is a partial front view of the apparatus of FIG. 2 in a modified position.

As shown in FIG. 2, with the switch handle 12 in the off position; hook 18 is removed from aperture 20 at the end of switch handle 12 and inserted through another aperture 24 in the switch handle 12 and through an aperture 26 in the locking ear 22.

The hot stick apparatus includes locking-out means comprising a second insulated rod 28 which is held spaced from and parallel to the rod 16 by a pair of annular guides 30 attached to supports 32 on rod 16. The annular guides 30 permit rod 28 to move axially. The upper end of rod 28 is connected to one end of a locking arm 34 that is pivotally mounted on rod 16. A spring 36 biases the locking arm 34 towards an open position as shown in FIG. 1 in which there is a gap between the end of hook 18 and the adjacent curved end 38 of the locking arm 34.

Referring to FIG. 2, after hook 18 bas been inserted through aperture 24 in switch handle 12 and aperture 26 in locking ear 22; the electrician may pull down on rod 28 moving it axially relative to rod 16 and causing locking arm 34 to pivot bring its curved end 38 into contact with the end of hook 18. An eyelet 40 at the lower end of rod 28 is now aligned with a fixed eyelet 42 which is connected to a support ring 44 on the rod 16. A padlock 46 or other conventional locking device is inserted through eyelets 40 and 42. This prevents inadvertent opening of the gap between hook 18 and locking arm 34, thereby preventing inadvertent movement of the switch handle 12 to the on position.

After maintenance is completed, padlock 46 is removed. Spring 36 now pivots locking arm 34 to its open position. Hook 18 may now be withdrawn from apertures 24 and 26, and reinserted into aperture 20 at the end of switch handle 12 to move the switch handle to its upper on position in which power is resupplied through switch 10.

Referring to FIG. 3, rather than inserting hook 18 through apertures 24 and 26; the same locking out result may be obtained by inserting the locking arm 34 through the apertures 26 and 24, and then closing the gap between hook 18 and end 38 of the locking arm 34.

It is intended to cover all such changes and modifications that fall within the scope and spirit of the appended claims.

I claim:

1. Electrical safety apparatus comprising an overhead electrical switch, a handle connected to said switch and movable from an on position wherein said switch is activated to an off position wherein said switch is deactivated, and a hot stick apparatus for engaging and moving said handle comprising an insulated rod having a hook at its upper end, said hook engaging said handle to move said handle between on and off positions, a locking ear contiguous to the off position of said handle, a locking arm to secure said handle to said locking ear when said handle is in the off position, and locking means connected to said arm to prevent inadvertent movement of said handle from the off position to the on position.

2. Apparatus according to claim 1, wherein said electrical switch comprises a buss bar switch.

3. Apparatus according to claim 1, wherein said locking means comprises a padlock.

4. Apparatus according to claim 1, wherein said hot stick apparatus further comprises a second rod connected to said insulated rod and movable axially relative thereto, said second rod having an upper end connected to and actuating said locking arm.

5. Apparatus according to claim 4, further comprising spring means to bias said locking arm to an inoperative position.

6. Apparatus according to claim 1, further comprising an aperture provided in said handle, and said hook extending through said aperture to move said handle.

* * * * *